US006161567A

United States Patent [19]

Ziehm

[11] Patent Number: 6,161,567

[45] **Date of Patent: *Dec. 19, 2000**

[54] SINGLE CHAMBER WATER CIRCULATOR

[76] Inventor: Raymond G. Ziehm, 6650 S. Sheridan Blvd., Littleton, Colo. 80123-6854

[ * ] Notice: This patent is subject to a terminal disclaimer.

[21] Appl. No.: 09/229,828

[22] Filed: Jan. 13, 1999

Related U.S. Application Data

[63] Continuation-in-part of application No. 08/957,831, Oct. 27, 1997, Pat. No. 5,918,625.

[51] Int. Cl.[7] ..... F16K 49/00

[52] U.S. Cl. ..... 137/357; 137/337

[58] Field of Search ..... 137/337, 357

[56] References Cited

U.S. PATENT DOCUMENTS

| | | | |
|---|---|---|---|
| 2,255,460 | 9/1941 | Weaver | 137/79 |
| 2,830,612 | 4/1958 | Taylor | 137/337 |
| 3,669,351 | 6/1972 | Meier et al. | 237/19 |
| 3,929,153 | 12/1975 | Hasty | 137/337 |
| 4,142,515 | 3/1979 | Skaats | 126/362 |
| 4,236,548 | 12/1980 | Howard | 137/335 |
| 5,331,996 | 7/1994 | Ziehm | 137/14 |
| 5,518,022 | 5/1996 | Ziehm | 137/15 |
| 5,622,203 | 4/1997 | Givler et al. | 137/337 |
| 5,671,771 | 9/1997 | Brandel | 137/337 |

*Primary Examiner*—John Fox
*Attorney, Agent, or Firm*—William E. Hein

[57] ABSTRACT

An integral water circulation device reliably provides rapid hot water at remote hot water faucets throughout a building by creating a low rate convective circulatory flow from the building water heater through a return line and the circulation device itself, without mixing hot and cold water within the system.

4 Claims, 1 Drawing Sheet

SINGLE CHAMBER WATER CIRCULATOR

REFERENCE TO RELATED APPLICATION

This application is a continuation-in-part application of pending, allowed U.S. patent application Ser. No. 08/957,831 entitled INTEGRAL WATER CIRCULATION APPARATUS, filed Oct. 27, 1997, now U.S. Pat. No. 5,918,625, the subject matter of which is incorporated herein by reference.

BACKGROUND AND SUMMARY OF THE INVENTION

This invention relates to an apparatus that will maintain heated water at remote hot water faucets in residential and small commercial buildings.

Considerable time and water are wasted daily awaiting hot water at faucets remote from the heater. In some plumbing installations this can take up to two minutes, and results in wasting 10 to 12 liters of water per occurrence and up to 8,000 liters of water per year in the average home. Many methods have been developed for resolution of this issue. The two primary approaches are: (1) an auxiliary remote water heater, either under the sink near the faucet, or in the basement below the sink, and (2) water circulation systems that bring heated water from the existing water heater to the faucet via the normal hot water pipes and circulate it back to the heater through a separate return line, thereby maintaining heated water at the remote hot water faucet and all hot water faucets between the heater and the remote faucet.

Auxiliary heaters like that described in U.S. Pat. No. 4,236,548 to Howard can be used for this purpose, but initial purchase cost, and the high cost of installation driven by the need to connect gas or electricity has limited their acceptance. Some auxiliary heaters are made for another purpose entirely, which is to provide very hot water at the sink through a separate faucet. Water supplied by these devices is hot enough to be used for soups and instant coffee and tea without additional heating. This concept and purpose is unrelated to the present invention.

Water circulation systems are generally grouped as convective or pumped circulation. Convective circulation systems as described in U.S. Pat. No. 3,929,153 to Hasty and U.S. Pat. No. 2,255,460 to Weaver employ water supply pipes to the remote faucet that slope upward and return lines from the faucet back to the heater inlet that slope downward. This arrangement is difficult to implement, especially when retrofitting existing buildings. Many of these installations, as described by Hasty, have the disadvantage of hot return line water being mixed with cold water in the cold water pipe. This lukewarm water must then be wasted if cold water is desired at a cold water tap. Heating of the cold water is a common problem in water circulation systems, and many installations do not lend themselves to the replumbing necessary to minimize it, nor does the owner want to bear the expense of replumbing. In addition, concerns are now being voiced as to the health risk associated with the use of water that has been heated for human consumption due to the increased solubility of lead and copper in heated water.

Pumps used for recirculation systems, as described in U.S. Pat. No. 3,669,351 to Meier et al. and U.S. Pat. No. 4,142,515 to Skaats, are functional, but require electrical power which may not be available in the desired location. These systems are very complex, using motors, seals, switches, bearings, timers, and control electronics, and are much more subject to failure. Operational costs to run the pump will be incurred, and a pump may produce noise that is objectionable to some people. The Skaats reference recognizes the undesirable tendency of heating of the cold water in the cold water distribution pipe by the mixing of warm water from the return line in pumped water circulation systems.

The aspirator activated hot water circulation systems taught by the present inventor in his U.S. Pat. Nos. 5,331,996 and 5,518,022 will perform well in almost all installations, whether or not convective flow is strong, and also those installations in which only a small return line can be installed. The single chamber concept of the present invention, having a lower manufacturing cost and being simpler to install, will perform well in a large majority of domestic applications, in addition to maintaining separation between warm return line water and cold water being supplied to cold water faucets. The small size of the present invention allows for installation in smaller spaces. The water circulator of the present invention is installed in the water supply pipe leading only to the water heater, leaving cold water pipes untouched in most applications. Local rerouting of the heater supply pipe may be required in some existing water systems. This extremely simple design can be fabricated with lower material costs, simpler tooling and machinery, and will require no sophisticated couplings to assemble.

DETAILED DESCRIPTION OF THE INVENTION

Figure 1A:
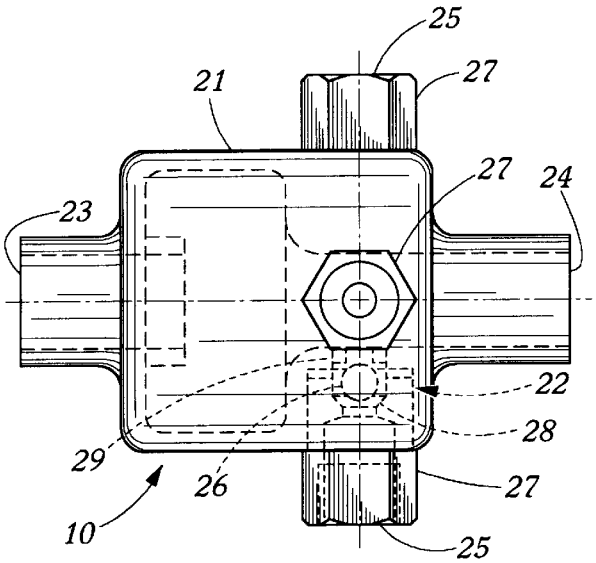
FIG. 1A is a sectional pictorial diagram of the water circulator of the present invention.
Figure 1B:
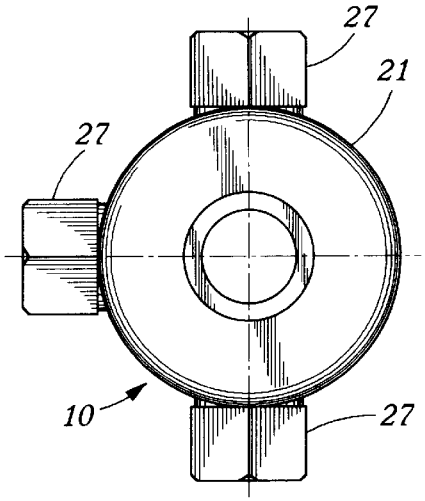
FIG. 1B is a right side pictorial diagram of the water circulator of FIG. 1.

Referring now to FIGS. 1A–B, there is shown a water circulator 10 in accordance with the present invention. Water circulator 10 comprises two major elements, a hollow housing 21 and a check valve assembly 22. Integral to the housing 21 are a cold water inlet 23, a heater supply outlet 24, and one or more return line inlets 25 incorporated into check valve seat fittings 27, all of which are compatible with conventional domestic water system components. Direct connection is provided internally between the cold water inlet 23 and the heater supply outlet 24. A quick response check valve assembly 22 is integrally associated with each return line inlet 25, oriented such as to prevent outflow of cold water from the interior of the housing 21 through the return line inlet 25. The check valve assembly 22 includes a movable poppet 26, shown as a ball for illustrative purposes, and a check valve seat fitting 27. The check ball 26 is free to move in a bore in the check valve seat fitting 27, and to engage a valve seat 28 integral to the valve seat fitting 27. A plurality of radial check ball retainers 29, protruding into the portion of the check ball bore situated in the housing 21, preclude the check ball 26 from entering the inner chamber of the housing 21, while permitting water to flow unimpeded in spaces between the check ball retainers 29. The check ball 26 is constructed of a material that has a specific gravity essentially equal to 1.0 to minimize any gravity effects while immersed in water, and to allow for rapid valve action under low flow conditions.

Figure 2:
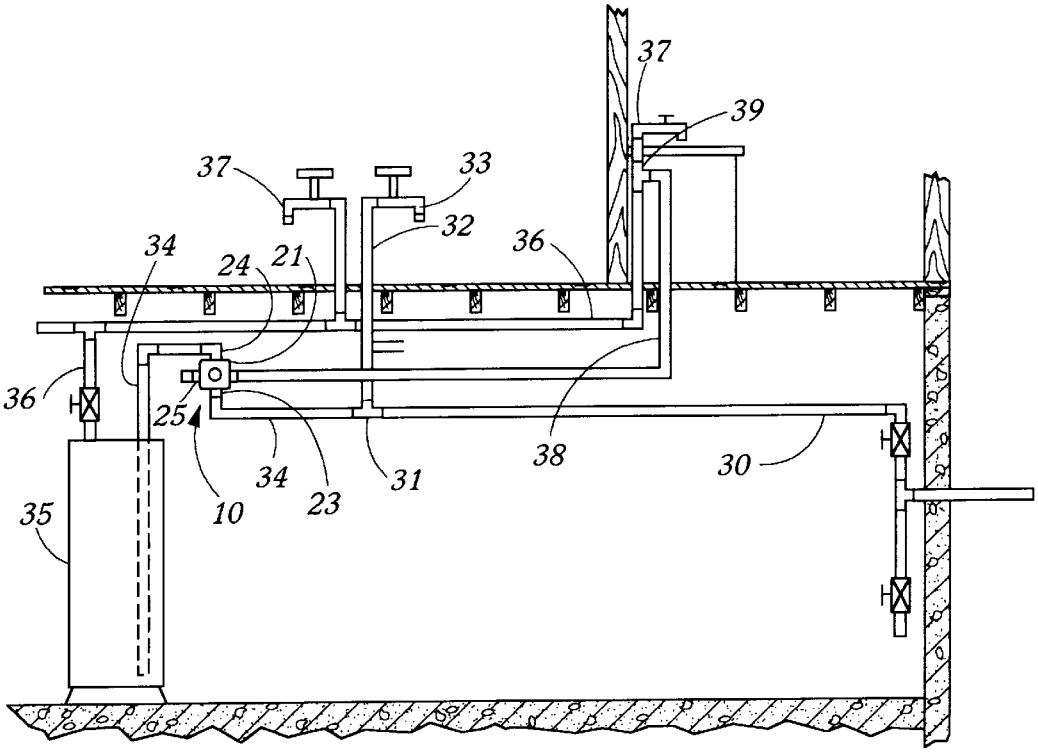
FIG. 2 is a pictorial diagram illustrating the water circulator of FIG. 1 installed in a typical residential water system.

Referring now to FIG. 2, the water circulator 10 of the present invention is shown installed in a typical domestic water system. Specifically, it is installed in the heater supply pipe 34 downstream of the distribution tee 31, one branch of which is coupled to the heater supply pipe 34. The water circulator 10 is oriented vertically with the cold water inlet 23 situated on the lower end and connected to the heater supply pipe 34. The heater supply outlet 24 on the upper end is connected to the heater supply pipe 34 leading to the heater 35 through a vertical section of pipe that extends upward to near the ceiling. Upon reaching a point above the heater, the heater supply pipe descends vertically to the heater inlet. The water circulator 10 is located at a level proximate the top of the heater 35 to allow the convective forces to function in a desired manner. Cold water flows through the other branch of the distribution tee 31, through the cold water distribution line 32, and then to the cold water faucets 33 in the building. Heated water from the heater 35 passes through the hot water distribution line 36 to the hot water faucets 37 in the building.

A return line 38 is coupled to the hot water distribution line 36 with a return line tee 39 proximate a remote hot water faucet 37, the other end of the return line being coupled to one return line inlet 25 of the water circulator 10. If multiple branches of the hot water distribution system are located in diverse directions from the heater, a return line can be brought back from each remote location and coupled to alternative multiple return line fittings to provide rapid hot water to the faucets on each hot water branch. If only a single return line is required in an application, additional return line inlets can simply be capped.

Operation of the water system of FIG. 2 with the water circulator 10 of the present invention installed therein employs convective forces produced by the cooling of warm water in the return line 38, making it more dense than the heated water flowing in the distribution line 36. This results in the upward flow of hot water in the distribution line 36 from the heater 35, and the downward flow of the cooler water in the return line 38, thus establishing a circulation flow from the heater 35 through the hot water distribution line 36, through the return line tee 39 and the return line 38, and then back to the water circulator 10. Once inside the water circulator 10, convective forces reliably route the warm return water flow upward and send it through the water heater supply line 34 back to the heater 35. Convective forces internal to the water circulator 10 will not allow warm water to flow downward toward the distribution tee 31 due to the low temperature of the water in the water heater supply line 34 near the distribution tee 31, thus precluding introduction of warm water into the cold water distribution line 32 and eventually into the cold water faucets 33.

As cold water is called for in the system, it flows from the water supply pipe 30 to the distribution tee 31 and then to the cold water distribution line 32 and all cold water faucets 33. When hot water is called for, it also flows from the water supply pipe, through the alternate branch of the distribution tee 31, through the heater supply pipe 34, the water circulator 10, the downstream portion of the heater supply pipe 34, the heater 35, and then through the hot water distribution line 36 to all hot water faucets 37 within the building. During those periods of time in which no water is used in the building, the convective flow described above will continue at a rate sufficient to maintain water temperature at remote faucets in the vicinity of 37 to 40 degrees Centigrade. This temperature provides for comfortable immediate use, with a gradual increase to near heater temperature, while minimizing heat loss to the atmosphere that would exist if the hot water distribution pipe 36 were to be maintained at heater temperature.

From the above description of the present invention, it is clear that the water circulator 10 will reliably and safely provide heated water to remote faucets at all times during which the heater 35 is operating, that it will not allow heated water to enter the cold water line, and that it will prevent any cold water from flowing in the reverse direction in the return line. A water distribution system so configured operates without electrical power or gas, and can accommodate multiple remote faucets located at opposite ends of the building. The water circulator 10 can be assembled at a significantly lower cost than any other known circulation device with equivalent capability. Installation is simplified in most cases, with the only moving part being the neutrally buoyant check ball 26.

I claim:

1. A water circulator for providing rapid hot water to one or more remotely located hot water faucets within a building, the water circulator comprising:

a cylindrical housing having top and bottom ends and a cylindrical wall that enclose a single internal chamber;

a cold water inlet positioned in the bottom end of said cylindrical housing for coupling said water circulator to a cold water supply line serving the building, said cold water inlet communicating through said bottom end of said cylindrical housing with said single internal chamber and being generally aligned with a longitudinal axis of said cylindrical housing;

a heater supply outlet positioned in the top end of said cylindrical housing for coupling said water circulator to a water heater serving the building, said heater supply outlet communicating through said top end of said cylindrical housing with said single internal chamber and being generally aligned with the longitudinal axis of said cylindrical housing; and one or more return line inlets positioned on an outer surface of said cylindrical wall proximate the top end of said cylindrical housing for coupling said water circulator to a proximal end of one or more return lines, a distal end of each of said one or more return lines being coupled proximate a respective one of said one or more remotely located hot water faucets within the building, each of said return line inlets communicating through said cylindrical wall with said single internal chamber, each of said return line inlets containing a check valve assembly that permits the flow of warm water from an associated one of said one or more return lines into said single internal chamber, but that prevents the flow of water in the reverse direction.

2. A water circulator as in claim 1 wherein said check valve assembly includes a poppet having a specific gravity substantially equal to 1.0.

3. A system for providing rapid hot water to one or more remotely located hot water faucets within a building, while preventing the introduction of heated water into cold water distribution lines within the building, the system comprising:

a main water line providing cold water to the building;

a water heater having an inlet for receiving cold water through the main water line, said water heater being operative for heating said cold water for distribution, through an outlet thereof, to said plurality of hot water faucets;

a hot water distribution line coupled to the water heater for distributing hot water to said one or more hot water faucets; and a water circulator comprising:

a cylindrical housing having top and bottom ends and a cylindrical wall that enclose a single internal chamber;

a cold water inlet positioned in the bottom end of said cylindrical housing for coupling said water circulator to said main water line serving the building, said cold water inlet communicating through said bottom end of said cylindrical housing with said single internal chamber and being generally aligned with a longitudinal axis of said cylindrical housing;

a heater supply outlet positioned in the top end of said cylindrical housing for coupling said water circulator to said inlet of said water heater, said heater supply outlet communicating through said top end of said cylindrical housing with said single internal chamber and being generally aligned with the longitudinal axis of said cylindrical housing; and one or more return line inlets positioned on an outer surface of said cylindrical wall proximate the top end of said cylindrical housing for coupling said water circulator to a proximal end of one or more return lines, a distal end of each of said one or more return lines being coupled proximate a respective one of said one or more hot water faucets, each of said return line inlets communicating through said cylindrical wall with said single internal chamber, each of said return line inlets containing a check valve assembly that permits the flow of warm water from an associated one of said one or more return lines into said single internal chamber, but that prevents the flow of water in the reverse direction;

said water circulator being oriented such that the top end thereof faces upward.

4. A system as in claim 3 wherein said check valve assembly includes a poppet having a specific gravity substantially equal to 1.0.

* * * * *